US007375691B1

(12) United States Patent
Chiang

(10) Patent No.: US 7,375,691 B1
(45) Date of Patent: May 20, 2008

(54) ANTENNA FRAMEWORK

(75) Inventor: Chi Ming Chiang, Pa-Te (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 11/683,453

(22) Filed: Mar. 8, 2007

(51) Int. Cl.
*H01Q 1/24* (2006.01)

(52) U.S. Cl. ..... 343/702; 343/700 MS; 343/895

(58) Field of Classification Search ..... 343/700 MS, 343/702, 895, 829, 846
See application file for complete search history.

(56) References Cited

U.S. PATENT DOCUMENTS 4,571,595 A * 2/1986 Phillips et al. ..... 343/745
6,639,559 B2 * 10/2003 Okabe et al. ..... 343/700 MS
7,209,096 B2 * 4/2007 Chau ..... 343/895
2006/0114076 A1 * 6/2006 Masuda et al. ..... 333/12
2008/0007469 A1 * 1/2008 Hung et al. ..... 343/702
2008/0012775 A1 * 1/2008 Shih ..... 343/702

* cited by examiner

*Primary Examiner*—Tho G Phan
(74) *Attorney, Agent, or Firm*—Ming Chow; Sinorica, LLC

(57) ABSTRACT

A broadband antenna framework used for receiving and emitting radio signals for a mobile communication device (such as a mobile phone). The mobile communication device is provided on an upper edge of its circuit board (having a grounding surface) with an antenna, and is provided between the antenna and the circuit board with a meandering line; the meandering line is provided thereon with components containing multilayer ceramic capacitors (MLCC) or multilayer ceramic inductors (MLCI); by using the capacitors or the inductors, the coupling effect between the grounding surface and the antenna can be insulated, so that there can be sufficient distance between the grounding surface and the antenna to radiate energy, the capacitors or the inductors do not result a direct current open circuit, hence other electronic elements can be laid around an antenna.

5 Claims, 5 Drawing Sheets

ANTENNA FRAMEWORK

BACKGROUND OF THE INVENTION

1. Field of the Invention

The present invention relates to an antenna framework, and especially to an antenna framework allowing electronic elements to be laid around an antenna.

2. Description of the Prior Art

For the purpose of making beautiful of mobile phones, mobile phones with hidden antennas have become main stream gradually, and planar antennas have been widely used too. In the mobile phone with a hidden antenna as shown in FIG. 1, its antenna 92 is provided on the upper edge of a circuit board 91, and a grounding surface 911 is provided on the bottom end of the circuit board 91. The antenna 92 and the grounding surface 911 must be provided therebetween with an insulated completely clear area "S" to form an electric field effect; the completely clear area "S" shall not be laid therein with any other electronic element in order that generating of impure signals is prevented. Generally, the distanced "t" of the completely clear area "S" at least is 7 mm.

Such design of the conventional antenna framework makes larger of the size of a mobile phone, this does not meet the requirement for compactness on the mobile communication device; and improvement is required.

SUMMARY OF THE INVENTION

The present invention provides a broadband antenna framework used for receiving and emitting radio signals for a mobile communication device (such as a mobile phone). The mobile communication device is provided on an upper edge of its circuit board (having a grounding surface) with an antenna, and is provided between the antenna and the circuit board with a meandering line; the meandering line is provided thereon with components containing multilayer ceramic capacitors (MLCC) or multilayer ceramic inductors (MLCI); by using the capacitors or the inductors, the coupling effect between the grounding surface and the antenna can be insulated, so that there can be sufficient distance between the grounding surface and the antenna to radiate energy, the capacitors or the inductors do not result a direct current open circuit, hence other electronic elements can be laid around an antenna.

The main object of the broadband antenna framework provided by the present invention is to give the probability of antenna designing without reducing the area of antenna, to make the antenna and the grounding surface need no very large completely clear area. And thereby the distanced of the completely clear area can be reduced from 7 mm to 2 mm.

The operated frequency of the broadband antenna framework of the present invention can contain GSM850, AMP850, CDMA800, GSM900, DCS and WCDMA.

DETAILED DESCRIPTION OF THE PREFERRED EMBODIMENT

Figure 1:
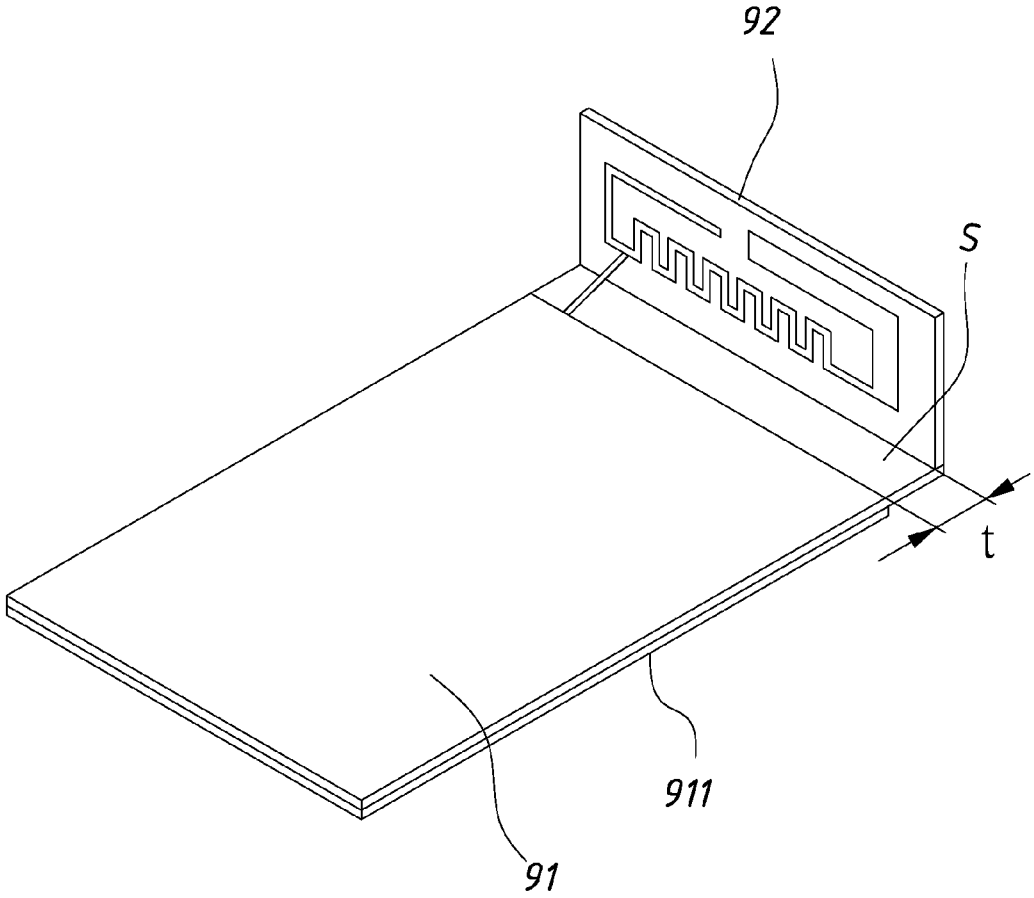
FIG.1 PRIOR ART
FIG. 1 represents a conventional antenna framework.
Figure 2:
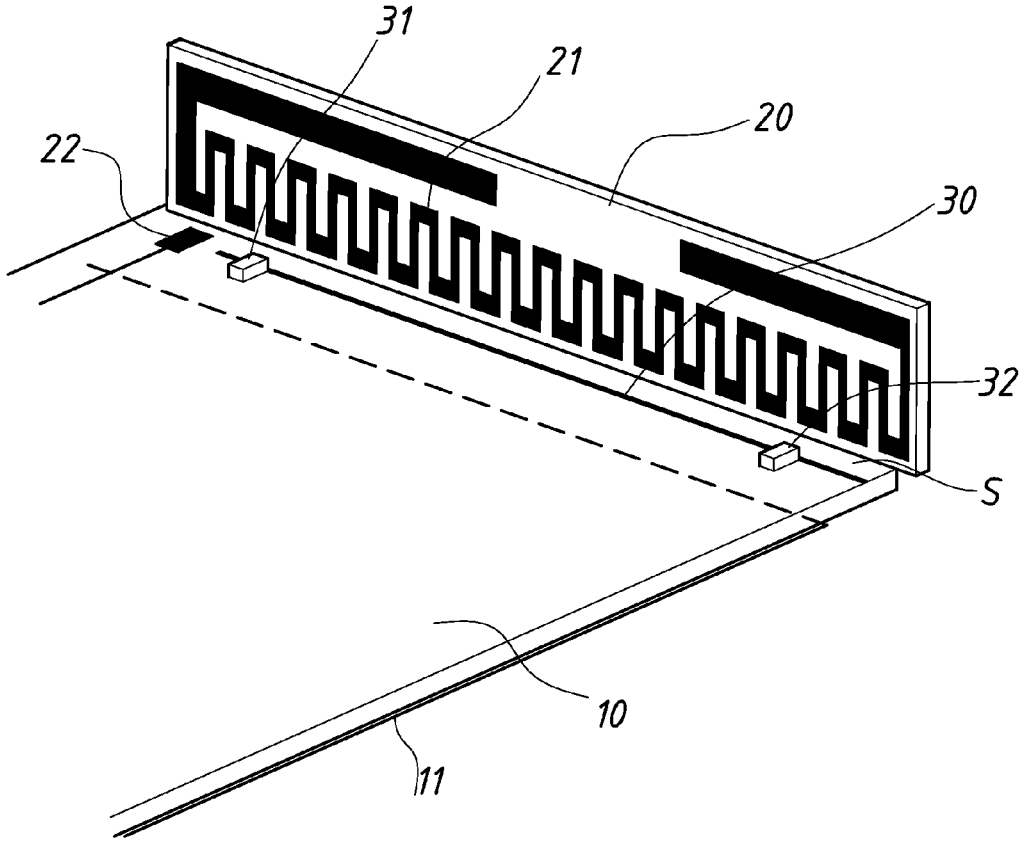
FIG. 2 shows the appearance of a first embodiment of the present invention.

Referring to FIG. 2 which shows a first embodiment of the present invention, the broadband antenna framework is used for receiving and emitting radio signals for a mobile communication device (such as a mobile phone). The mobile communication device is provided on an upper edge of its circuit board 10 with an antenna 20, and the bottom of the circuit board 10 is provided with a grounding surface 11. The antenna 20 has a radiating metallic element 21 which has a feed-in connecting pin 22 in connection with a coaxial cable (not shown). In this embodiment, the antenna 20 is a planar antenna having a length, a width and a height: 40 mm (L)×1 mm (W)×6 mm (H).

The present invention is provided between the antenna 20 and the grounding surface 11 of the circuit board 10 with a meandering line 30; the meandering line 30 is provided thereon with components containing multilayer ceramic capacitors or multilayer ceramic inductors 31, 32.

By virtue that impedances of the multilayer ceramic capacitors or multilayer ceramic inductors 31, 32 are immense for alternate electric current, they can insulate the alternate electric current of the grounding surface 11, by using the capacitors or the inductors 31, 32, the coupling effect between the grounding surface 11 and the antenna 20 can be insulated, so that there can be sufficient distance between the grounding surface 11 and the antenna 20 to radiate energy, the capacitors or the inductors 31, 32 do not result a direct current open circuit, hence other electronic elements can be laid around an antenna 20.

Moreover, the present invention has the object of getting the probability of designing of the antenna 20 without reducing the area of the grounding surface 11, to make the antenna 20 and the grounding surface 11 need no very large completely clear area "S"; so that the distanced of the completely clear area "S" can be reduced from 7 mm to 2 mm.

Figure 3:
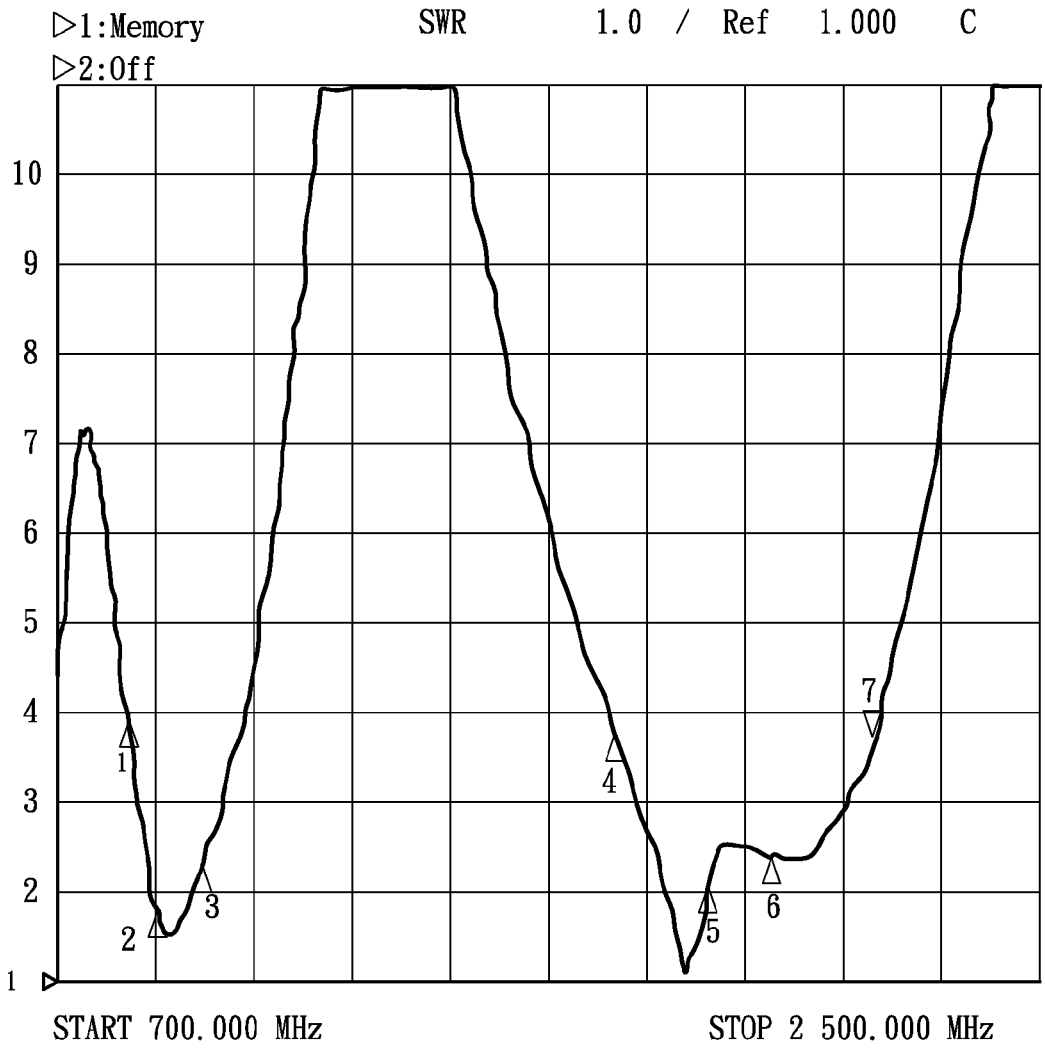
FIG. 3 is a standing wave voltage ratio (VSWR) diagram of the embodiment of FIG. 2.

FIG. 3 is a standing wave voltage ratio (VSWR) diagram obtained by testing of the first embodiment of the present invention; the followings are the 3D gains and efficiencies obtained by testing:

| Pornance | GSM850/ CDMA800 | GSM900 | GSM1800 | GSM1900 | WCDMA |
|---|---|---|---|---|---|
| 3D gain | −3.4 | −3.1 | −2.89 | −4.1 | −4.95 |
| efficiency | 45% | 48.5% | 52% | 40% | 32% |

We can see from the above that, the results obtained by testing on the broadband antenna framework of the present invention show us quite good impedance broadband characteristics and effects of radiation. Therefore, the broadband antenna framework of the present invention and its operated frequency can contain GSM850, AMP850, CDMA800, GSM900, DCS and WCDMA.

Figure 4:
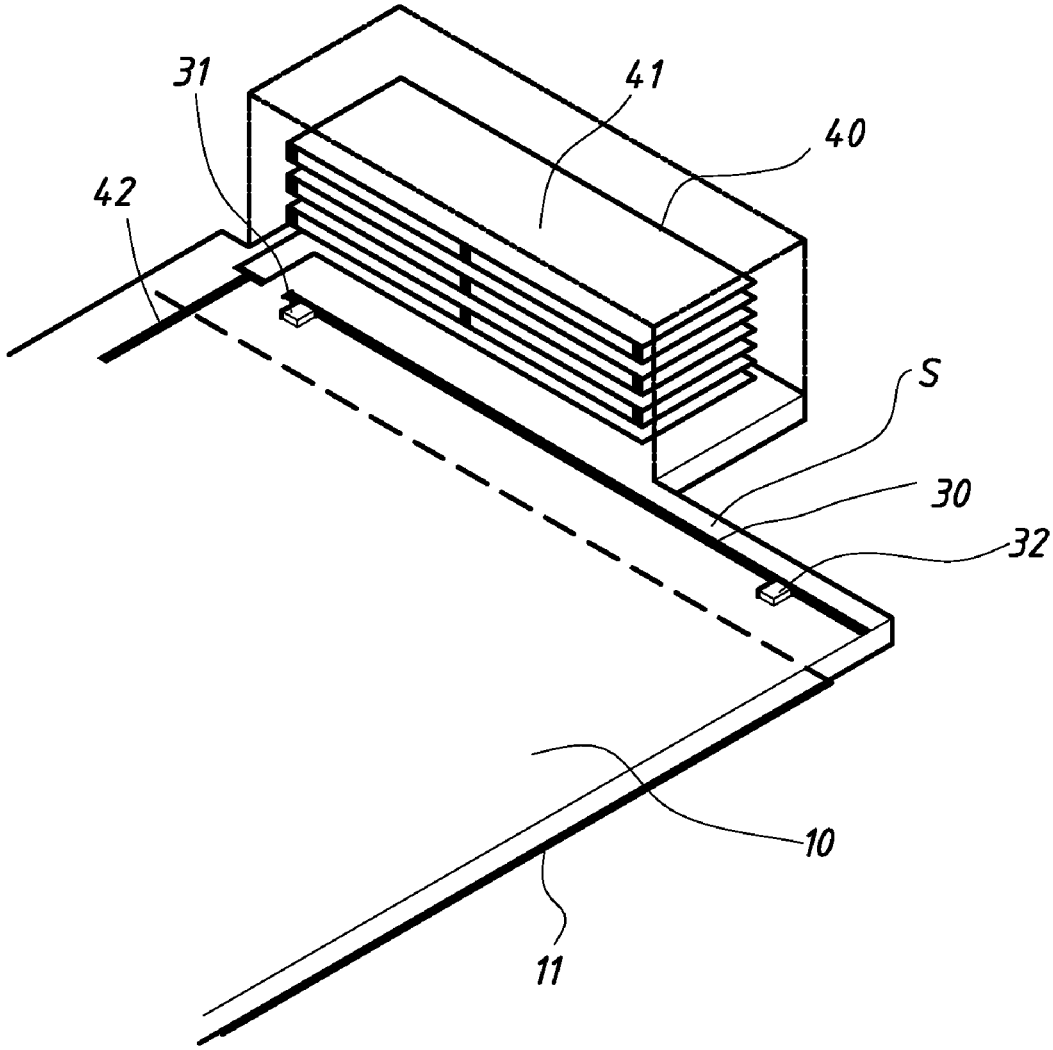
FIG. 4 is a perspective view showing the appearance of a second embodiment of the present invention.

Referring to FIG. 4 which shows a second embodiment of the present invention, it is different from the first embodiment depicted in FIG. 2 in that: an antenna 40 of it is a multilayer foldable antenna and includes a metallic element 41 and a feed-in pin 42, and has a length, a width and a height: 22 mm (L)×8 mm (W)×5.3 mm (H).

Figure 5:
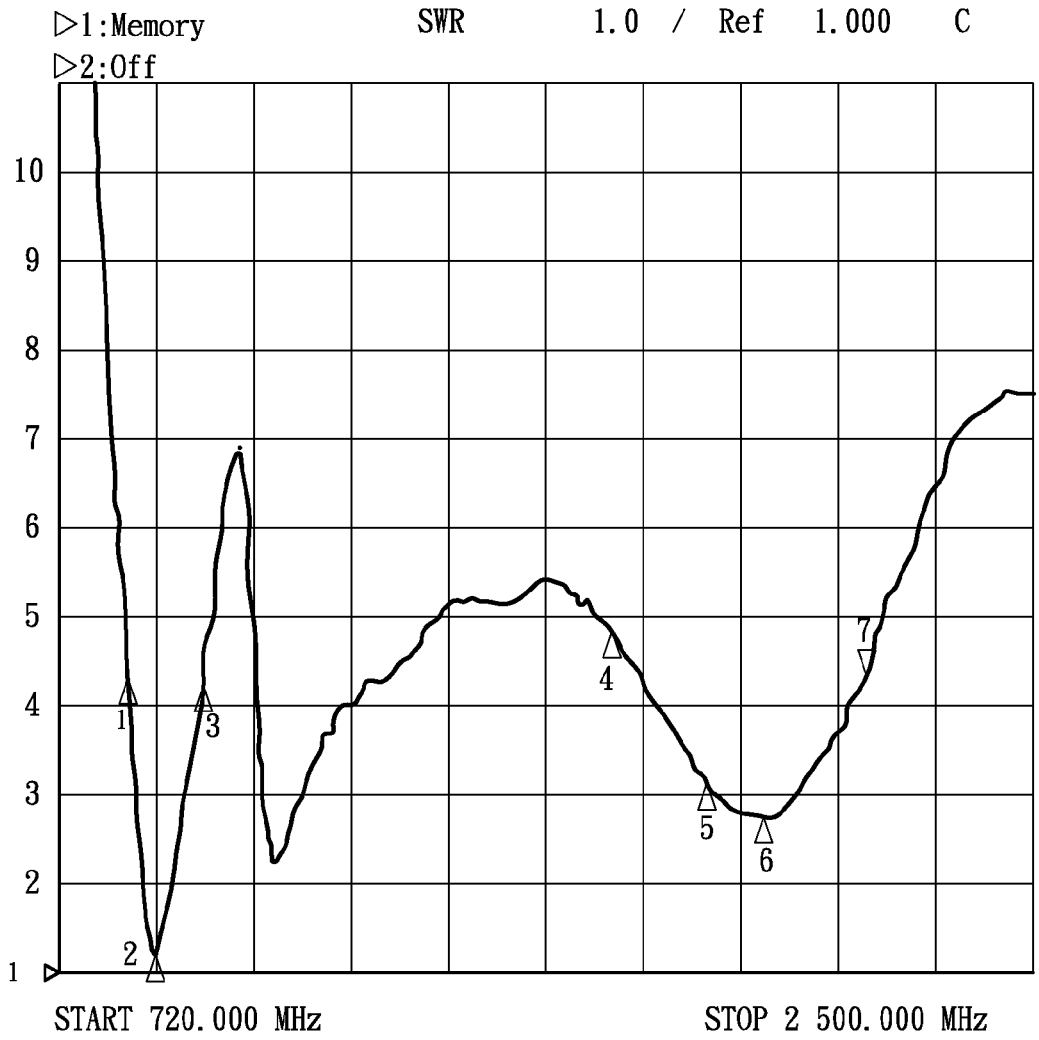
FIG. 5 is a standing wave voltage ratio (VSWR) diagram of the embodiment of FIG. 4.

FIG. 5 shows a standing wave voltage ratio (VSWR) diagram of the second embodiment, and the followings are the 3D gains and efficiencies obtained by testing:

| Pormance | GSM850/ CDMA800 | GSM900 | GSM1800 | GSM1900 | WCDMA |
|---|---|---|---|---|---|
| 3D gain | −4.2 | −3.5 | −3.0 | −2.1 | −3.0 |
| efficiency | 35% | 45% | 50% | 60% | 50% |

We can see from the above that, the results obtained by testing on the broadband antenna framework of the present invention also show us quite good impedance broadband characteristics and effects of radiation.

In conclusion, the present invention takes advantages of the MLCC and MLCI elements on the meandering line to reduce the completely clear area between the grounding surface and the antenna; this allows electronic elements to be laid around an antenna, and can reduce the size of a whole mobile communication device.

Having thus described the technical process of my invention with high industrial value, what I claim as new and desire to be secured by Letters Patent of the United States is:

1. A broadband antenna framework used for receiving and emitting radio signals for a mobile communication device, said framework comprises:

a circuit board provided in said mobile communication device and having at least a grounding surface, an antenna provided on an upper edge of said circuit board and having a radiating metallic element;

a meandering line provided between said antenna and said grounding surface of said circuit board, said meandering line is provided thereon with components containing multilayer ceramic capacitors or multilayer ceramic inductors; by using said capacitors or said inductors, a coupling effect between said grounding surface and said antenna is insulated, so that there is sufficient distance between said grounding surface and said antenna to radiate energy, said capacitors or said inductors do not result a direct current open circuit, hence other electronic elements are allowed to be laid around said antenna.

2. The broadband antenna framework as defined in claim 1, wherein said antenna is a planar antenna.

3. The broadband antenna framework as defined in claim 1, wherein said antenna is a multilayer foldable antenna.

4. The broadband antenna framework as defined in claim 1, wherein said distance between said grounding surface and said antenna is about 3 mm.

5. The broadband antenna framework as defined in claim 1, wherein operated frequency of said broadband antenna framework at least contains GSM850, AMP850, CDMA800, GSM900, DCS and WCDMA.

* * * * *